US010279942B1

(12) United States Patent
Laible

(10) Patent No.: US 10,279,942 B1
(45) Date of Patent: May 7, 2019

(54) AUTOMATIC DETECTION SYSTEM FOR DETECTING DISRUPTIONS IN THE FLOW TO A DISPENSING APPARATUS

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 192 days.

(21) Appl. No.: 15/443,106

(22) Filed: Feb. 27, 2017

Related U.S. Application Data

(60) Provisional application No. 62/447,124, filed on Jan. 17, 2017.

(51) Int. Cl.

| | |
|---|---|
| ***B65B 57/18*** | (2006.01) |
| ***B67D 7/56*** | (2010.01) |
| ***B67D 7/62*** | (2010.01) |
| ***G08B 7/06*** | (2006.01) |

(52) U.S. Cl.
CPC ..... *B65B 57/18* (2013.01); *B67D 7/565* (2013.01); *B67D 7/62* (2013.01); *G08B 7/06* (2013.01)

(58) Field of Classification Search
CPC ..... B65B 57/18; B67D 7/565; B67D 7/62; G08B 7/06
See application file for complete search history.

(56) References Cited

U.S. PATENT DOCUMENTS

| | | | | |
|---|---|---|---|---|
| 7,028,724 | B2 * | 4/2006 | Cohen | F02M 21/0206 141/392 |
| 7,059,363 | B2 * | 6/2006 | Sugiyama | G05D 7/0664 137/486 |
| 7,694,691 | B2 * | 4/2010 | Wodjenski | F17C 13/04 137/240 |
| 8,182,462 | B2 * | 5/2012 | Istoc | A61M 5/142 604/504 |
| 9,586,306 | B2 * | 3/2017 | Zhang | B24C 7/0046 |
| 2005/0005994 | A1 * | 1/2005 | Sugiyama | G05D 7/0664 141/4 |
| 2012/0101474 | A1 * | 4/2012 | Istoc | A61M 5/142 604/504 |
| 2014/0045409 | A1 * | 2/2014 | Zhang | B24C 7/0046 451/2 |

* cited by examiner

*Primary Examiner* — Nicolas A Arnett
(74) *Attorney, Agent, or Firm* — Dennis L. Thomte; Thomte Patent Law Office LLC

(57) ABSTRACT

An automatic detection system for detecting disruptions in the flow of liquid from one more liquid containers to a dispensing apparatus. If the system detects an interruption of the flow of liquid to the dispensing apparatus, a visual alarm, an audio alarm, or a data alarm is activated. Three embodiments of the system are disclosed.

22 Claims, 4 Drawing Sheets

AUTOMATIC DETECTION SYSTEM FOR DETECTING DISRUPTIONS IN THE FLOW TO A DISPENSING APPARATUS

CROSS REFERENCE TO RELATED APPLICATION

This Non-Provisional patent application claims priority from the Provisional Application Ser. No. 62/447,124 filed Jan. 17, 2017 entitled AN AUTOMATIC DETECTION SYSTEM FOR DETECTING DISRUPTIONS IN THE FLOW TO A DISPENSING APPARATUS.

BACKGROUND OF THE INVENTION

Field of the Invention

This invention relates to an automatic detection system for detecting disruptions in the flow of liquid to a dispensing apparatus. Even more particularly, this invention relates to an automatic detection system which detects an interruption of the flow of liquid to a dispensing apparatus and which includes a visual alarm, an audio alarm, or a data alarm which are activated when the flow of liquid to a dispensing apparatus has been disrupted.

Description of the Related Art

There are many situations where it is desired to dispense liquid chemicals or other liquids into a receptacle having water or other liquid therein. There are also other situations where it is desirable to mix the liquid chemicals with water prior to the mixture being discharged into a receptacle. There are also situations wherein both of the above methods are required to be performed at one station where there is a need for injecting liquid chemicals into a first receptacle having water or other liquid therein and there is a need for mixing liquid chemicals with water prior to being discharged into another receptacle.

In each of those situations, the liquid chemicals are in a container such as a bottle with the chemicals being drawn therefrom by a pump or other means. Usually, the liquid chemical containers are not closely monitored as to the amount of liquid chemical remaining in the liquid chemical container. If the liquid chemical container becomes empty, the proper amount of chemical will not be supplied to the receptacle. Further, if the pumps run empty, they may become damaged.

There is therefore a need to provide an electronic detection system which includes an alarm which may audibly, visually or data indicate that the liquid chemical container is empty or some other disruption in the flow has occurred. There is also a need for remotely controlling the systems by way of a computer, a lap top, a tablet or a cell phone.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

Three embodiments of an automatic detection system for detecting disruptions in the liquid flow to a dispensing apparatus are disclosed. In the first embodiment, the system has a valve module preferably positioned on a vertically disposed support with the valve module having a first liquid outlet port, a first liquid intake port, and an electrically operated first valve, which is movable between closed and open positions, positioned between the first liquid intake port and the first liquid outlet port. The valve module also includes an outlet port. A first liquid container, such as a bottle, is provided which has a liquid outlet with the first liquid container being spaced from the valve module and with the liquid outlet of the first liquid container being in fluid communication with the first liquid intake port of the valve module.

An alarm module is also provided in the first embodiment which is positioned remotely from the valve module. The outlet port of the valve module is in communication with the alarm module. The alarm module includes a visual alarm, an audible alarm, and a data alarm. The visual alarm, the audible alarm and the data alarm are activated upon the flow of liquid from the first liquid container to the valve module being disrupted.

In the first embodiment of the invention, a pump is spaced from the valve module for selectively drawing liquid from the first liquid container through the first valve of the valve module, when the first valve is moved from its closed position to its open position, and through the first liquid output port of the valve module to supply the liquid to a remote receptacle. A computer driven controller is provided which controls the operation of the pump for drawing liquid from the first liquid container, the first valve of the valve module and the alarm module.

Should the flow of liquid be disrupted from the first liquid container to the valve module, a suction sensor in the alarm module will sense a pressure differential in the system and will cause the alarms to be activated. The controller will then deactivate the system. When the disruption has been corrected such as replacing an empty liquid container with a filled liquid container, the system will be restarted.

The second embodiment of the invention is essentially identical to the first embodiment except that the system of the second embodiment includes a second liquid container. In the second embodiment, the system has a valve module preferably positioned on a vertically disposed support with the valve module having a first liquid outlet port, a first liquid intake port, a second liquid intake port and an outlet port. The valve module of the second embodiment includes an electrically operated first valve, which is movable between closed and open positions, positioned between the first liquid intake port and the first liquid outlet port. A first liquid container, such as a bottle, is provided which has a liquid outlet with the first liquid container being spaced from the valve module and with the liquid outlet of the first liquid container being in fluid communication with the first liquid intake port of the valve module.

The second embodiment of the invention includes a second liquid container as stated above, such as a bottle, which has a liquid outlet with the second liquid container being spaced from the valve module and with the liquid outlet of the second liquid container being in fluid communication with the second liquid intake port of the valve module. In the second embodiment, the valve module includes an electrically operated second valve, which is movable between closed and open positions, positioned between the second liquid inlet port and the first liquid outlet port.

The second embodiment also includes an alarm module, which is identical to the alarm module of the first embodiment. The second embodiment further includes a controller which is identical to the controller of the first embodiment. The outlet port of the valve module is in communication with the alarm module of the second embodiment.

Should the flow of liquid be disrupted from the first liquid container to the valve module, a suction sensor in the alarm module will sense a pressure differential in the system and either cause the alarms to be activated and/or cause the controller to close the first valve in the valve module and open the second valve in the valve module so that the liquid in the second liquid container will be drawn into and through the valve module. Should the second liquid container become empty, the alarm module will be activated to alert the personnel of the disruption of the flow of liquid from the second liquid container and the controller will deactivate the system. When the disruption has been corrected, the system will be restarted.

In the third embodiment, the pump of the first and second embodiments is replaced with a Venturi module, which is connected to a source of water under pressure, thereby drawing liquid from the first liquid container, if the system only includes a single liquid container, or from either the first and second liquid containers, if the system includes first and second liquid containers or more. In the third embodiment, the passage of water through the Venturi module sucks or draws liquid from the associated liquid container or containers and mixes the liquid from the container or containers with the water supply which is then directed to a receptacle.

It is therefore a principal object of the invention to provide an automatic detection system which detects disruptions in the flow to a dispensing apparatus.

A further object of the invention is to provide an automatic detection system which detects disruptions in the flow to a dispensing apparatus with the system including an audible alarm, a visual alarm, or a data alarm which indicates that there has been a disruption in the flow of liquid to a dispensing apparatus.

Yet another object of the invention is to provide an automatic detection system of the type described wherein the dispensing system is computer controlled.

Still another object of the invention is to provide an automatic detection system of the type described wherein the chemicals in containers may be drawn therefrom by a peristaltic pump, a piston pump, a hydraulic pump, other types of pumps, or a Venturi apparatus.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
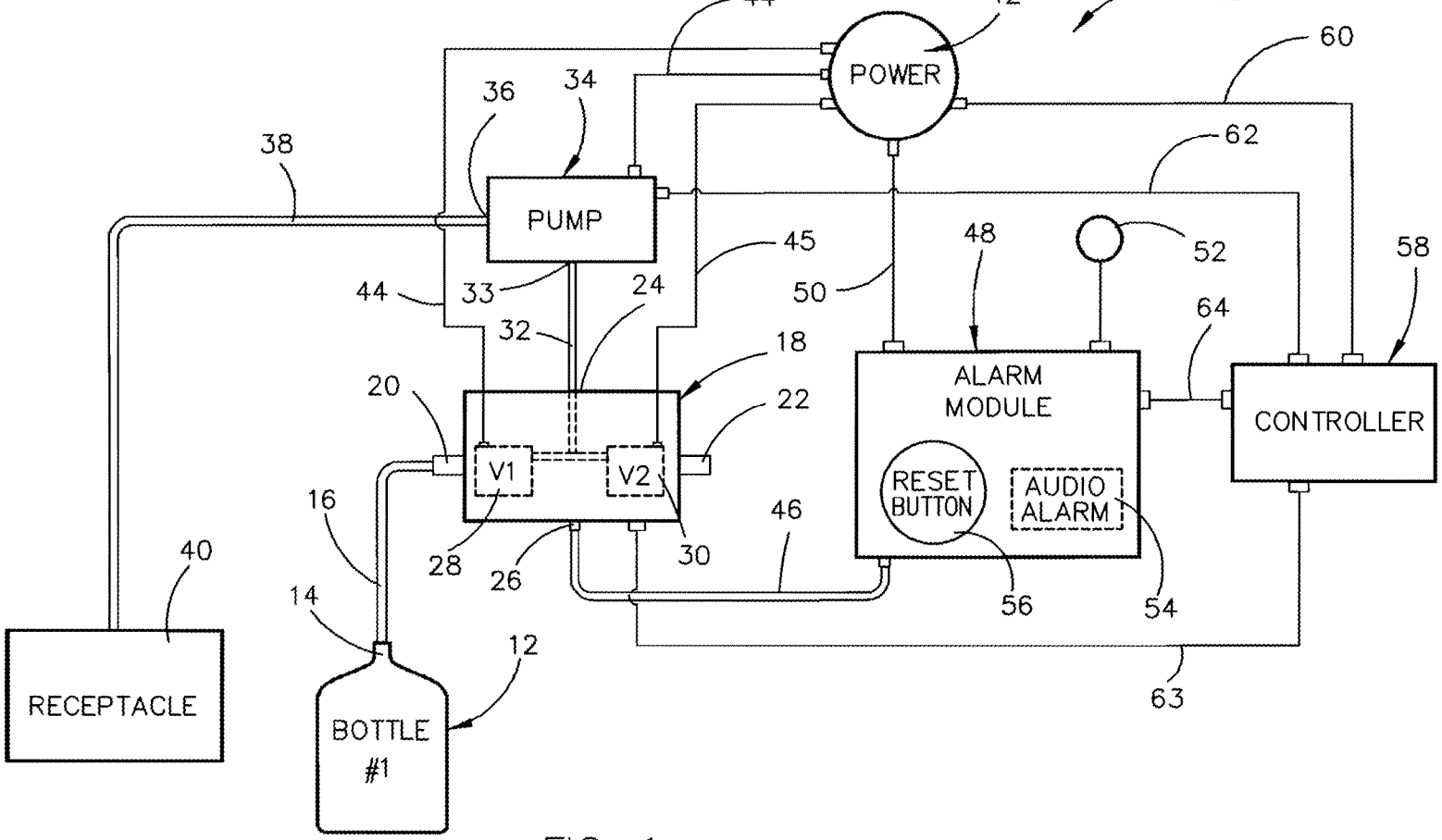
FIG. 1 is a schematic of the first embodiment of the invention.

The first embodiment of the automatic detection system for detecting disruptions in the flow to a dispensing apparatus is referred to by the reference numeral 10 and is depicted in schematic form in FIG. 1. The numeral 12 refers to a liquid container, such as a bottle, which will usually contain chemicals but could contain other liquids. An insert 14 is inserted into the neck of the container 12 and may be of the type such as shown in my earlier insert patents, namely U.S. Pat. Nos. 9,242,847; 9,126,725; and 8,708,203 the disclosures of which are incorporated herein to complete this disclosure if necessary.

A flexible tube 16 extends from insert 14 of container 12 for supplying liquid to a valve module 18 which is available in the marketplace. Valve module 18 will usually be mounted on a vertically disposed support such as a wall, bracket, etc. Valve module 18 includes a first liquid intake port 20, a second liquid intake port 22, which is not utilized in the FIG. 1 embodiment, a first liquid outlet port 24 and a second outlet port 26. It should be noted that the container 12 may be positioned above valve module 18.

Valve module 18 includes an electrically operated valve 28 of conventional design and an electrically operated valve 30 of conventional design, which is not utilized in the FIG. 1 embodiment. As seen, tube 16 is fluidly connected to the first liquid intake port 20 of valve module 18. Valve 28 is imposed in the liquid passageway in valve module 18 between ports 20 and 24 thereof. When valve 28 is in its open position, liquid may pass therethrough so that the liquid is supplied to the port 24. When valve 28 is closed, liquid may not pass therethrough.

A flexible tube 32 has one end thereof fluidly connected to port 24 of valve module 18 and has its other end fluidly connected to the liquid intake port 33 of pump 34. In this embodiment, the pump 34 is a peristaltic hose pump. However, other pumps such as a radial piston pump, a gear pump, a vane pump, a lobe pump, a piston pump, etc., could be used. Further, a Venturi device could be substituted for the pump 34 as will be described hereinafter. The discharge side 36 of pump 34 has a hose, tube or pipe 38 extending therefrom to a receptacle 40 such as a sink, a tub, etc.

The valves 28 and 30 of module 18 are electrically connected to a conventional power source 42 by leads 44 and 45. A flexible tube 46 extends from the outlet port 28 of valve module 18 to an alarm module or box 48. Alarm module 48 is electrically connected to the power source 42 by a lead or leads 50. Alarm module 48 includes a visual signal device such as a light 52. Alarm module 48 also includes an audible signaling or warning device 54. Alarm module 48 will usually include a data alarm. Alarm module 48 includes a conventional suction or vacuum sensor (not shown) therein which senses the pressure differential in tube 46 to activate the devices 52, 54 and the data alarm as will be described hereinafter. The alarm module 48 also includes a lighted reset button 56.

The numeral 58 refers to a computer driven controller which is electrically connected to the power source 42 by a lead or leads 60. Controller 58 is electrically connected to pump 34 by a lead or leads 62. Controller 58 is electrically connected to valve module 18 by a lead or leads 63. Controller 58 is electrically connected to the alarm module 48 by a lead or leads 64.

Figure 2:
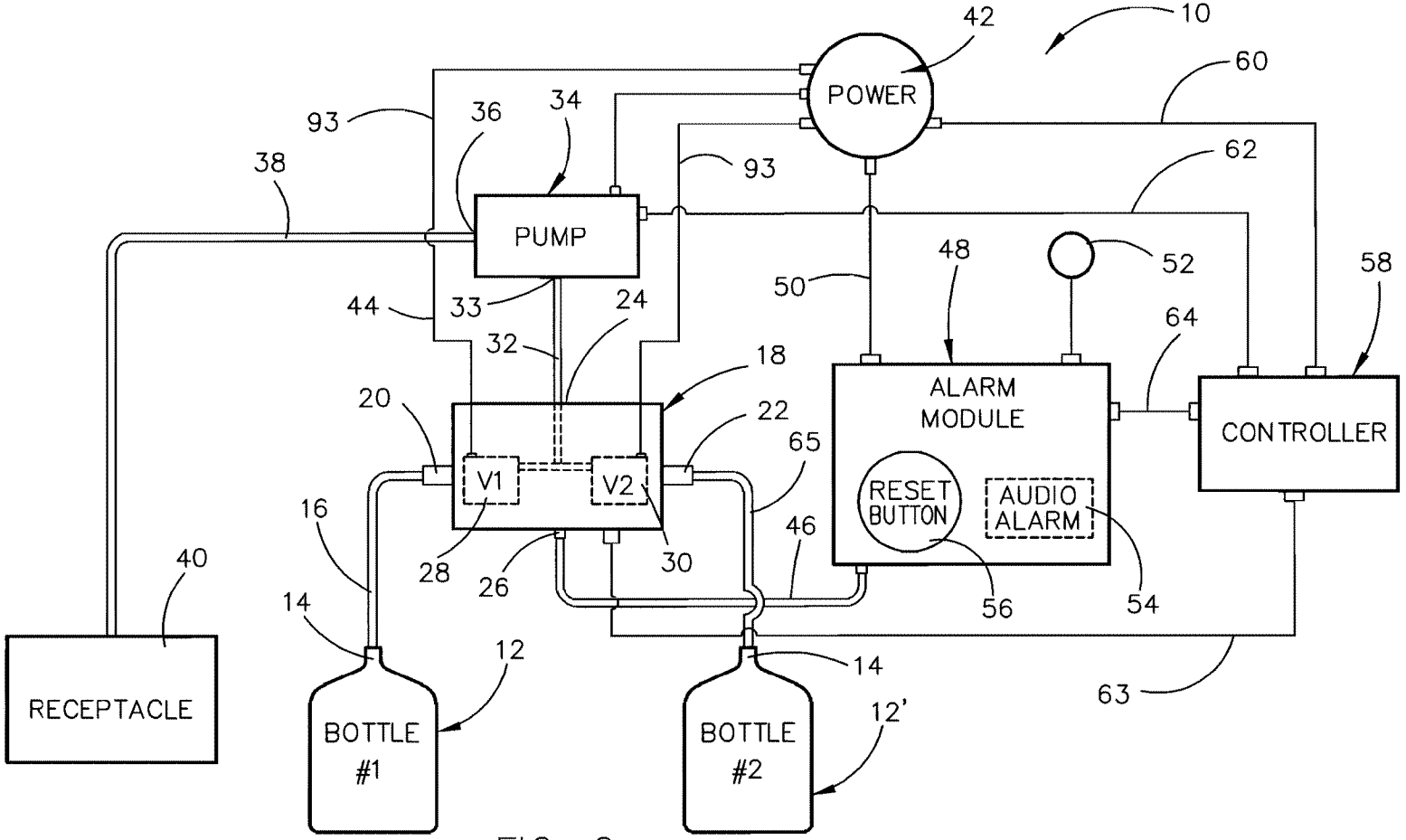
FIG. 2 is a schematic of the second embodiment of the invention.

The second system of FIG. 2 is identical to the system of FIG. 1 except that a second liquid container 12' is utilized. Container 12' is identical to liquid container 12. Container 12' is fluidly connected to the intake side of valve 30 by a tube or pipe 65. It should be noted that the liquid containers 12 and 12' may be positioned above the valve module 18.

Figure 3:
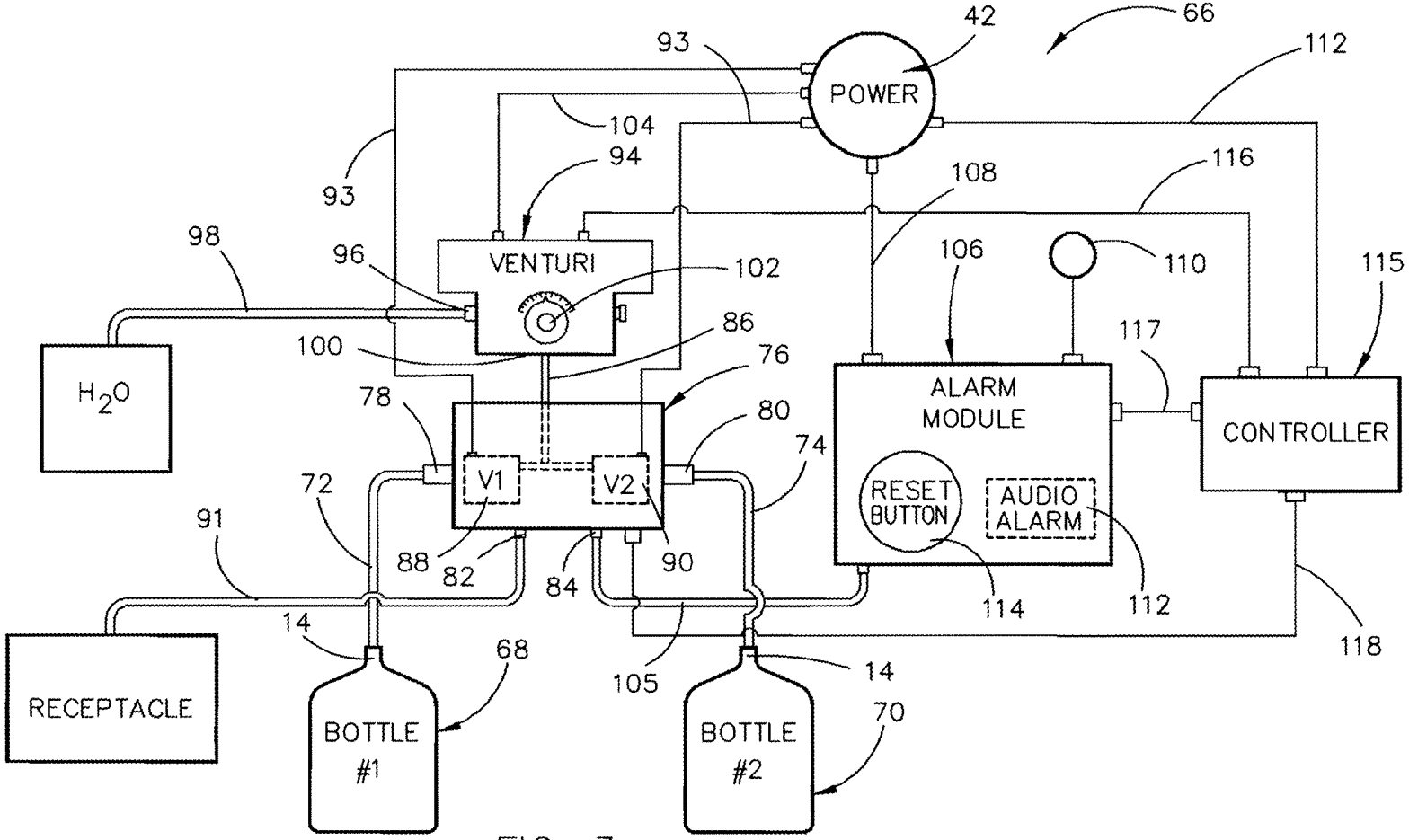
FIG. 3 is a schematic of the third embodiment of the invention.
Figure 4:
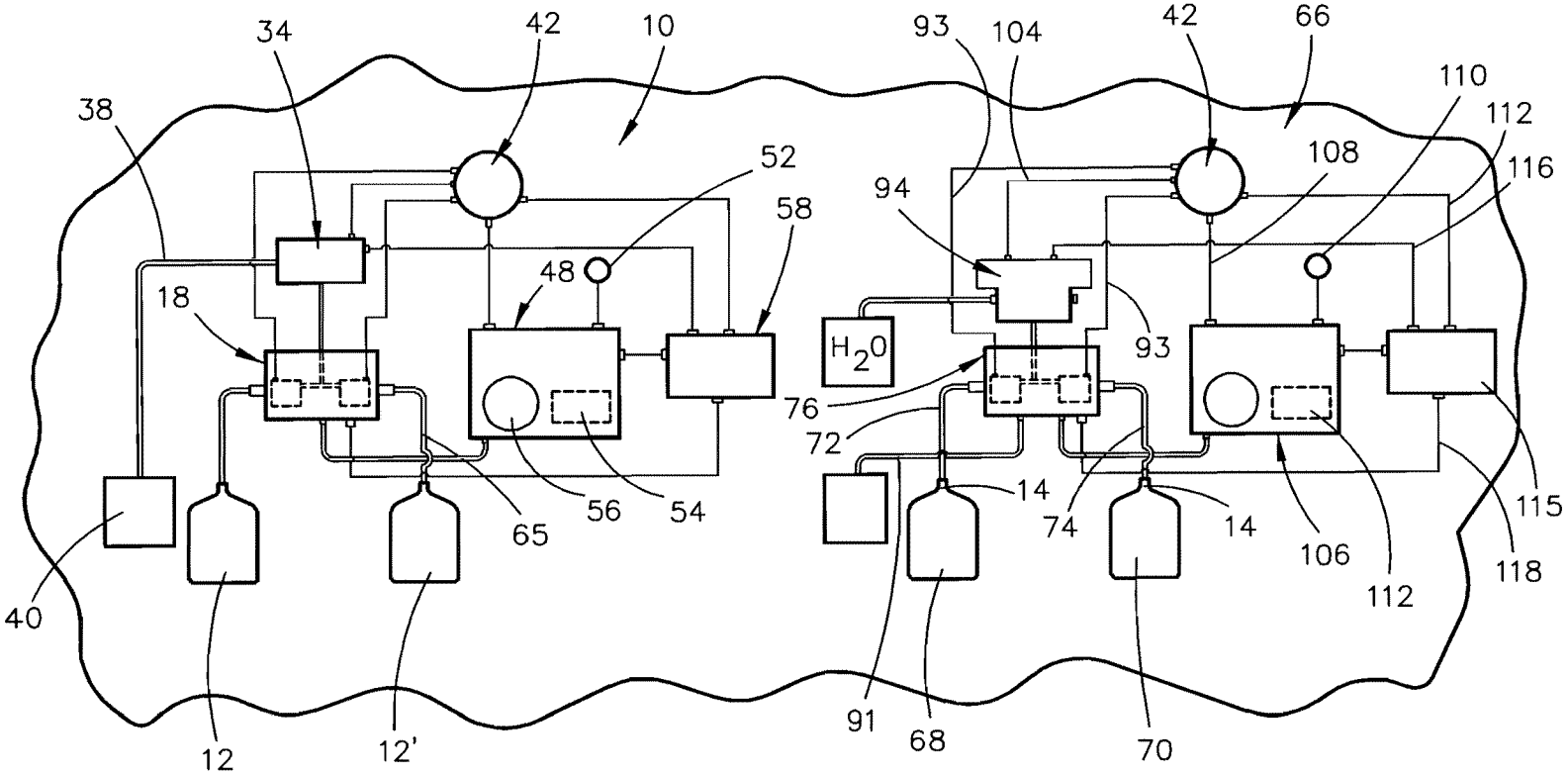
FIG. 4 is a schematic of the possible relationship of the third embodiment of this invention with the second embodiment of this invention.

FIG. 3 is a schematic drawing of a third system 66 which may be used in conjunction with the system of FIG. 1, the system of FIG. 2 or stand alone. In FIG. 4, the third system 66 will be illustrated as being used in conjunction with the system of FIG. 2.

The numerals 68 and 70 refer to liquid containers which are identical to containers 12 and 12' of FIG. 2. The liquid containers 68 and 70 such as bottles will usually contain chemicals but could contain other liquids. An insert 14 is inserted into each of the necks of the containers 68 and 70 and may be of the type shown in my earlier patents, namely U.S. Pat. Nos. 9,242,847; 9,126,725; and 8,708,203 the disclosure of which are incorporated herein to complete this disclosure if necessary.

A flexible tube 72 extends from the insert 14 of container 68 to valve module 76 and a flexible tube 74 extends from neck 14 of container 70 to valve module 76. Valve module 76 is essentially identical to module 18 as described hereinabove. Valve module 76 will usually be mounted on a vertically disposed support such as a bracket. Valve module 76 and the system 66 are preferably positioned at one side of the system of FIG. 1 or the system of FIG. 2 so that the two systems may be selectively used at a single location and so that the system 66 may be connected to certain components of the systems of FIGS. 1 and 2 such as the power source 42 and controller 58. For purposes of clarity, the system 66 will be described as a stand-alone system. Valve module 76 includes a first liquid intake port 78, a second liquid intake port 80, a first liquid outlet port 82, and an outlet port 84. Valve module 76 also includes a tube like member 86 which is in communication with the electrically operated valves 88 and 90 which are conventional in design and which are identical to the valves 28 and 30 of the module 18 of FIG. 2.

As seen, tube 72 is fluidly connected to fluid intake port 78 of valve module 76 so as to be on the intake side of valve 88. Valve 88 is imposed in the liquid passageway in valve module 76 between port 78 and the lower end of the member 86. When valve 88 is in its open position, liquid may pass therethrough so that liquid is supplied to the port 82.

As also seen, a flexible tube 92 extends from port 80 of valve module 76 to the insert 14 in container 70. Valve 90 is imposed in the liquid passageway in valve module 76 between port 80 and the lower end of the member 86. When valve 90 is in its open position, liquid may pass therethrough so that liquid is supplied to port 82. Valve module 76 includes a tube 91 which extends from port 82 to a receptacle as seen in FIG. 3. Valve module 76 is electrically connected to the power source 42 by a pair of leads 93. It should be noted that the containers 68 and 70 could be positioned above valve module 76.

The numeral 94 refers to a conventional Venturi module having a water intake port 96 which has a hose 98 connected thereto which is in communication with a source of liquid under pressure such as water. A conventional Venturi is positioned within a water passageway in Venturi module 94 to create a Venturi or suction effect as the liquid passes from the Venturi module 94 by way of the liquid outlet port 100 of Venturi module 94 into the upper end of member 86. Preferably, the Venturi module 94 includes a rotatable adjustment knob 102 to vary the Venturi effect within the Venturi module 94. As seen, Venturi module 94 is electrically connected to the power source 42 by a lead or leads 104.

A flexible tube 105 extends from the outlet port 84 of valve module 76 to an alarm module or box 106 which is identical to alarm module 48. Alarm module 106 is electrically connected to the power source 42 by a lead or leads 108. Alarm module 106 includes a visual signal device such as a light 110. Alarm module 106 also includes an audible or warning device 112. Alarm module 106 also may include a data alarm. Alarm module 106 includes a conventional or vacuum sensor (not shown) therein which senses the pressure differential in tube 105 to activate alarm devices 110 and 112 as well as the data alarm. The alarm module 106 also includes a lighted reset button 114. The alarm module 106 is electrically connected to a computer driven controller 115 by a lead or leads 116. Controller 115 is identical to controller 58. Controller 115 is electrically connected to Venturi module 94 by a lead or leads 116. Alarm module 106 is electrically connected to Controller 115 by a lead or leads 117. Controller 115 controls the operation of valve 88, valve 90, alarm module 106 and the flow of water to the Venturi module 94. Controller 115 is electrically connected to the valve module 76 by a lead or leads 118.

The operation of the automatic detection system of FIG. 1 will now be described. A container 12 having the desired liquid therein is placed into position. The controller 58, at predetermined times, will activate alarm module 48, module 18, the valve 28 and the pump 34. At that time, valve 28 will be moved to its open position. The operation of the pump 34 draws liquid from the container 12 by way of the tube 16, port 20, valve 28, port 24, and tube 32. The pump 34 discharges the liquid therefrom by way of the discharge side 36 and hose or tube 38 into the receptacle 40. At a predetermined time, as controlled by controller 58, the system will halt the pumping of liquid into the receptacle 40.

If the container 12 becomes empty or some malfunction occurs in the system, the flow of liquid to the pump 34 will be disrupted. When such disruption of flow occurs, the pressure differential or suction in tube 46 will be changed and sensed by the suction sensor within alarm module 48. The change in the pressure differential will cause the visual, data and audible signaling devices to be activated. The controller 58 will then close valve 28 and shut down pump 34. The visual, data and audible devices will alert the operator or attendant that a disruption has occurred. The controller 58 may also alert personnel by cell phone or other means that the disruption has occurred.

The attendant will then place a filled liquid container in place and connect the container to the module 18. The attendant will then press the reset button 56 to restart the system.

The system of FIG. 2 is identical to the system of FIG. 1 except that a second liquid container 12' will be placed into the system. Container 12' is fluidly connected by tube 65 to the second liquid intake port 22 of the module 18 and the valve 30 will become functional. The containers 12 and 12' will normally contain the same liquid but they could contain different liquids. Thus, the controller 58 may place either bottles 12 or 12' into operation. Normally, the container 12 will be in operation before the container 12'. At any time, the controller 58 may switch the system taking one container out of operation and placing the other container into operation.

The system of FIG. 3 operates in the same way as the system of FIG. 2 except that the Venturi module 94 has been substituted for the pump 34. Water under pressure is supplied to the Venturi module 94 from the water source under pressure. As water passes through the Venturi module 94, the Venturi in the Venturi model sucks or draws liquid from either of the liquid containers 68 and 70 and causes the liquid from the containers 68 and 70 to be mixed with the water supplied to the Venturi module which is then passed through the port 82 and the tube 91 to the associated receptacle.

Should the flow of liquid from the containers 68 and 70 to the valve module 76, or some other disruption occur, the suction sensor in alarm module 106 will activate the alarms in alarm module 106 thereby alerting personnel that such disruption has occurred. When the disruption has been corrected, the resent button 114 on alarm module 106 will be pressed to restart the system.

FIG. 4 illustrates a situation wherein the system of FIG. 2 is used in conjunction with the system of FIG. 3. In such an arrangement, the two systems could utilize a single controller and a single alarm module. The system of FIG. 1 could also be used with the system of FIG. 3.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. An automatic detection system for detecting disruptions in the flow to a dispensing apparatus, comprising:

a valve module;

said valve module having a first liquid inlet port, a first liquid outlet port, an outlet port, and an electrically operated first valve positioned between said first liquid intake port and said first liquid outlet port of said valve module;

said first valve being movable between open and closed positions;

a first liquid container having a liquid outlet;

said first liquid container being spaced from said valve module;

said liquid outlet of said first liquid container being in fluid communication with said first liquid intake port of said valve module;

an alarm module positioned remotely from said valve module;

said outlet port of said valve module being in communication with said alarm module;

said alarm module including at least one of a visual alarm, a data alarm and an audible alarm;

at least one of said visual alarm, said data alarm and said audible alarm being activated upon the flow of liquid from said first liquid container to said valve module being disrupted;

means spaced from said valve module for selectively supplying liquid from said first liquid container through said first valve, when said first valve is moved from its closed position to its open position, and through said first liquid output port of said valve module and supplying the liquid to a remote receptacle;

and a computer driven controller which controls the operation of said means for supplying liquid from said first liquid container, said first valve, and said alarm module.

2. The automatic detection system of claim 1 wherein said means for supplying liquid from said first liquid container comprises a pump means.

3. The automatic detection system of claim 1 wherein said means for supplying liquid from said first liquid container comprises a Venturi means.

4. The automatic detection system of claim 1 wherein said means for supplying liquid from said first liquid container comprises a radial piston pump.

5. The automatic detection system of claim 1 wherein said means for supplying liquid from said first liquid container comprises a gear pump.

6. The automatic detection system of claim 1 wherein said means for supplying liquid from said first liquid container comprises a vane pump.

7. The automatic detection system of claim 1 wherein said means for supplying liquid from said first liquid container comprises a peristaltic hose pump.

8. The automatic detection system of claim 1 wherein said means for supplying liquid from said first liquid container comprises a lobe pump.

9. The automatic detection system of claim 1 wherein said means for supplying liquid from said first liquid container comprises a piston pump.

10. The automatic detection system of claim 1 wherein said alarm module includes a reset button.

11. An automatic detection system for detecting disruptions in the flow to a dispensing apparatus, comprising:

a valve module;

said valve module having a first liquid outlet port, a first liquid intake port, a second liquid intake port, an outlet port, a normally closed electrically operated first valve positioned between said first liquid intake port and said first liquid outlet port and a normally closed electrically operated second valve positioned between said second liquid intake port and said first liquid outlet port;

each of said first and second valves being movable between open and closed positions;

a first liquid container having a liquid outlet;

said first liquid container being spaced from said valve module;

said liquid outlet of said first liquid container being in fluid communication with said first liquid intake port of said valve module;

a second liquid container having a liquid outlet;

said second liquid container being spaced from said valve module;

said liquid outlet of said second liquid container being in fluid communication with said second liquid intake port of said valve module;

an alarm module positioned remotely from said valve module;

said outlet port of said valve module being in communication with said alarm module;

said alarm module including at least one of a visual alarm, a data alarm and an audible alarm;

said at least one of said visual alarm, said data alarm and said audible alarm being activated upon the flow of liquid from said first liquid container to said valve module being disrupted;

said at least one of said visual alarm, said audible alarm and said data alarm being activated upon the flow of liquid from said liquid outlet of said second liquid container to said second liquid inlet port of said valve module being disrupted;

means for selectively supplying liquid from said first liquid container through said first valve, when said first valve is moved from its closed position to its open position, and through said first liquid output port of said valve module and supplying the liquid to a remote receptacle;

said means for selectively supplying liquid from said first liquid container also being configured to selectively supply liquid from said second liquid container through said second valve, when said second valve is moved from its closed position to its open position, and through said first liquid output port of said valve module and supplying the liquid to a remote receptacle;

and a computer driven controller which controls the operation of said means for supplying liquid from said first and second liquid containers, said first and second valves, and said alarm module.

12. The automatic detection system of claim 11 wherein said means for supplying liquid from said first and second liquid containers comprises a pump means.

13. The automatic detection system of claim 11 wherein said means for supplying liquid from said first and second liquid containers comprises a Venturi means.

14. The automatic detection system of claim 11 wherein said means for supplying liquid from said first and second liquid containers comprises a radial piston pump.

15. The automatic detection system of claim 11 wherein said means for supplying g liquid from said first and second liquid containers comprises a gear pump.

16. The automatic detection system of claim 11 wherein said means for supplying liquid from said first and second liquid containers comprises a vane pump.

17. The automatic detection system of claim 11 wherein said means for supplying liquid from said first and second liquid containers comprises a peristaltic hose pump.

18. The automatic detection system of claim 11 wherein said means for supplying liquid from said first and second liquid containers comprises a lobe pump.

19. The automatic detection system of claim 11 wherein said means for supplying liquid from said first and second liquid containers comprises a piston pump.

20. The automatic detection system of claim 11 wherein said alarm module includes a reset button.

21. An automatic detection system for detecting disruptions in the flow to a dispensing apparatus, comprising:

a valve module positioned on a vertically disposed support;

said valve module having a first liquid outlet port, a first liquid intake port, an outlet port, and an electrically operated first valve positioned between said first liquid intake port and said first liquid outlet port of said valve module;

said first valve being movable between open and closed positions;

a first liquid container having a liquid outlet;

said first liquid container being spaced from said valve module;

said liquid outlet of said first liquid container being in fluid communication with said first liquid intake port of said valve module;

an alarm module positioned remotely from said valve module;

said outlet port of said valve module being in communication with said alarm module;

said alarm module including at least one of a visual alarm, a data alarm and an audible alarm;

at least one of said visual alarm, said data alarm and said audible alarm being activated upon the flow of liquid from said first liquid container to said valve module being disrupted;

a Venturi module spaced from said valve module which has a water inlet port which is in fluid communication with a source of water under pressure, a Venturi in said Venturi module which is in communication with the water coming into said Venturi module, and a water discharge opening which is in fluid communication with said valve module;

said Venturi of said Venturi module being in communication with said first liquid container whereby said water passing into and through said Venturi of said Venturi module will create suction therein to draw liquid from said first liquid container through said first valve, when said first valve is moved from its closed position to its open position, and through said first liquid output port of said valve module and supplying the water and liquid mixture to a remote receptacle;

and a computer driven controller which controls the operation of said Venturi module, said first valve, and said alarm module.

22. An automatic detection system for detecting disruptions in the flow to a dispensing apparatus, comprising:

a valve module;

said valve module having a first liquid outlet port, a first liquid intake port, a second liquid intake port, an outlet port, a normally closed electrically operated first valve positioned between said first liquid intake port and said first liquid outlet port and a normally closed electrically operated second valve positioned between said second liquid intake port and said liquid outlet port;

each of said first and second valves being movable between open and closed positions;

a first liquid container having a liquid outlet;

said first liquid container being spaced from said valve module;

said liquid outlet of said first liquid container being in fluid communication with said first liquid intake port of said valve module;

a second liquid container having a liquid outlet;

said second liquid container being spaced from said valve module;

said liquid outlet of said second liquid container being in fluid communication with said second liquid intake port of said valve module;

an alarm module positioned remotely from said valve module;

said outlet port of said valve module being in communication with said alarm module;

said alarm module including at least one of a visual alarm, a data alarm and an audible alarm;

at least one of said visual alarm, said data alarm and said audible alarm being activated upon the flow of liquid from said first liquid container to said valve module being disrupted;

at least one of said visual alarm, said audible alarm and said data alarm being activated upon the flow of liquid from said liquid outlet of said second liquid container to said second liquid inlet port of said valve module being disrupted;

a Venturi means having an inlet side and a discharge side;

said inlet side of said Venturi means being in fluid communication with a source of water under pressure;

said Venturi means selectively drawing liquid from said first container through said first valve, when said first valve is moved to its said open position thereby mixing the liquid from said first container with the water passing through said Venturi means and through said first liquid outlet port of said valve module as water passes through said Venturi means and supplying the water and liquid mixture to a remote receptacle;

said Venturi means also selectively drawing liquid from said second container through said second valve, when said second valve is moved from its closed position to its open position thereby mixing the liquid from said container with the water passing through said Venturi means and through said second liquid outlet port of said valve module as water passes through said Venturi means and supplying the water liquid mixture to a remote receptacle;

and a computer driven controller which controls the operation of said Venturi means, said first valve, said second valve, and said alarm module.

* * * * *